US005902346A

United States Patent [19]

Cullen et al.

[11] Patent Number: 5,902,346

[45] Date of Patent: May 11, 1999

[54] FUEL DELIVERY CONTROL BASED ON ESTIMATED FUEL TEMPERATURE

[75] Inventors: Michael J. Cullen, Northville; Darwin A. Becker, Livonia; John W. Holmes, Eastpointe, all of Mich.

[73] Assignee: Ford Global Technologies, Inc., Dearborn, Mich.

[21] Appl. No.: 08/660,366

[22] Filed: Jun. 7, 1996

[51] Int. Cl.[6] ..... F02D 41/00

[52] U.S. Cl. ..... 701/102

[58] Field of Search ..... 701/102, 103, 701/104; 123/497, 491, 458, 459, 463; 364/431.04

[56] References Cited

U.S. PATENT DOCUMENTS

| | | | |
|---|---|---|---|
| 4,635,606 | 1/1987 | Koike et al. | 123/463 |
| 4,982,331 | 1/1991 | Miyazaki | 364/431.04 |
| 5,179,925 | 1/1993 | Orminski | 123/491 |
| 5,220,895 | 6/1993 | Curran et al. | 123/491 |
| 5,237,975 | 8/1993 | Betki et al. | 123/497 |
| 5,355,859 | 10/1994 | Weber | 123/497 |
| 5,379,741 | 1/1995 | Matysiewicz et al. | 123/497 |
| 5,574,645 | 11/1996 | Meeker et al. | 364/431.04 |
| 5,586,539 | 12/1996 | Yonekawa et al. | 123/458 |
| 5,663,881 | 9/1997 | Cook, Jr. | 701/104 |

*Primary Examiner*—Willis R. Wolfe
*Assistant Examiner*—Hieu T. Vo
*Attorney, Agent, or Firm*—Mark S. Sparschu

[57] ABSTRACT

In one embodiment of the present invention, a method for estimating temperature of fuel in a fuel delivery system of a motor vehicle engine includes the step of calculating a fuel temperature estimate in an engine running state as a function of fuel flow rate, engine coolant temperature and intake air temperature.

In a second embodiment of the present invention, a method for estimating temperature of fuel in a fuel delivery system of a motor vehicle engine includes the step of calculating a fuel temperature estimate in an engine not running state as a function of a fuel temperature estimate when the engine was last in a running state, time the engine has been in the not running state, engine coolant temperature and intake air temperature.

16 Claims, 2 Drawing Sheets

FUEL DELIVERY CONTROL BASED ON ESTIMATED FUEL TEMPERATURE

BACKGROUND OF THE INVENTION

1. Field of the Invention

The present invention relates to motor vehicle fuel systems.

2. Description of the Related Art

In the control of fuel delivery to a motor vehicle engine, knowledge of the temperature of the fuel being delivered can frequently be advantageous. An "electronic returnless" fuel system is one fuel system in which such knowledge of fuel temperature can be advantageous. In an "electronic returnless" fuel system, the speed of the fuel pump is feedback-controlled such that exactly the required amount of fuel is delivered to the engine. Thus, the conventional return fuel line to the fuel tank can be eliminated. In such an "electronic returnless" fuel system, the ability to control fuel pump speed (and therefore fuel pressure) can be used to advantage to prevent fuel vaporization in the fuel rail of the engine. If such vaporization is impending, the fuel pressure can be increased as a countermeasure. Reducing fuel vaporization can improve engine starting and driveability.

However, to provide such a countermeasure, the temperature of the fuel in the fuel rail should preferably be known. Of course, the prior art recognizes that a fuel temperature sensor can be used to sense fuel temperature. But, with the ever-increasing pressures for motor vehicle cost efficiency, an alternative means for sensing fuel temperature which does not require a dedicated sensor can provide substantial advantages over the prior art.

SUMMARY OF THE INVENTION

The present invention provides a method for controlling fuel delivery in a fuel delivery system of a motor vehicle engine. The method comprises the step of calculating a fuel temperature estimate in an engine running state as a function of fuel flow rate, engine coolant temperature and intake air temperature to the engine. The method also comprises the step of modifying the fuel delivery in view of the fuel temperature estimate in an engine running state.

Additionally, the present invention provides a digital memory device adapted to direct a microcomputer to estimate temperature of fuel in a fuel delivery system of a motor vehicle engine. The memory device comprises means for directing a microcomputer to calculate an average of engine coolant temperature and engine intake air temperature. The memory device further includes means for directing a microcomputer to determine a factor as a function of fuel flow rate. In addition, the memory device comprises means for directing a microcomputer to determine a steady-state fuel temperature approximation in an engine running condition as:

$$FT_SS=FT_MUL*(FT_FORC-AMB_TEMP)+AMB_TEMP,$$

wherein FT_SS is the steady-state fuel temperature approximation, FT_MUL is the factor, FT_FORC is the weighted average of engine coolant temperature and engine intake air temperature, and AMB_TEMP is an inferred ambient temperature.

By providing the ability to estimate fuel temperature being delivered to the engine of a motor vehicle without the use of a fuel temperature sensor, the present invention provides substantial advantages over the prior art.

DETAILED DESCRIPTION OF THE PREFERRED EMBODIMENT

Figure 1:
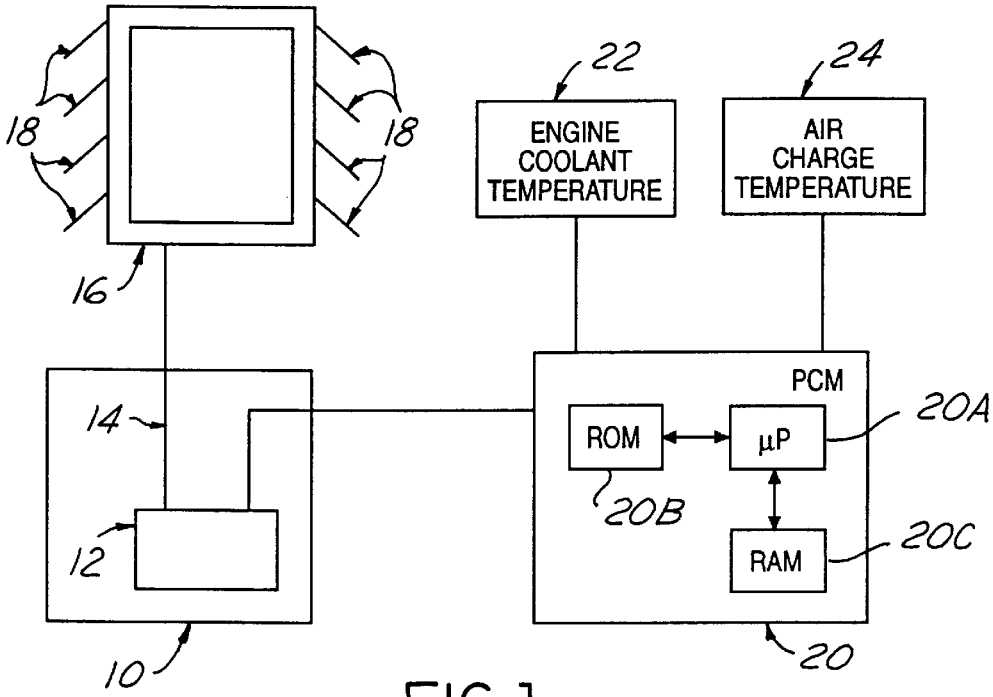
FIG. 1 is a fuel system according to one embodiment of the present invention.

Refer first to FIG. 1, where relevant portions of a fuel delivery system for a motor vehicle are illustrated. The fuel delivery system includes a fuel tank 10 in which is disposed a fuel pump 12. Fuel pump 12 delivers fuel via a fuel line 14 to a fuel rail 16, which is mounted on the vehicle's engine. Coupled to fuel rail 16 are one or more fuel injectors 18, which deliver fuel for combustion to the cylinders of the engine.

The fuel system of FIG. 1 is shown without a fuel line to return excess fuel from fuel rail 16 to fuel tank 10. That is, the fuel system of FIG. 1 is of the "returnless" type. A powertrain control module 20 controls the speed of fuel pump 12 such that only that fuel required for delivery to the engine by fuel injectors 18 is provided to fuel rail 16. Thus, a return fuel line is not required.

Powertrain control module 20 is preferably a microprocessor-based component with sufficient microprocessor resources (memory, throughput, inputs, outputs and the like) to perform the functions attributed to it herein. Powertrain control module 20 includes a microprocessor 20A, read-only memory (ROM) 20B, and random access memory (RAM) 20C. The software which directs the operation of microprocessor 20A is included in ROM 20B, which can be any of a number of varieties of read-only memory such as programmable read-only memory (PROM) or electrically-erasable programmable read-only memory (EEPROM). ROM 20B can be included on board microprocessor 20A, as separate integrated circuit(s), or a combination of both. RAM 20C preferably includes a combination of "keep-alive RAM," which is powered and thus retains its memory even after powertrain control module 20 powers down, and "volatile RAM," which is reinitialized each time powertrain control module 20 is powered up. Powertrain control module 20 performs a variety of engine management functions, including the fuel pump control noted above. The structure of powertrain control module 20 is well-known to those skilled in the art of engine control electronics.

An engine coolant temperature sensor 22 provides a signal to powertrain control module 20 which indicates the temperature of the coolant within the engine. This signal is used in a number of the engine management functions performed by powertrain control module 20. Also, an air charge temperature sensor 24 provides a signal to powertrain control module 20 which indicates the temperature of the air within the intake manifold of the engine. Again, this signal is used in a number of the engine management functions performed by powertrain control module 20.

It is desirable to minimize vaporization of the fuel in fuel rail 16. Vaporization occurs due to high temperature and is thus particularly likely in high temperature and hot re-start conditions. Because powertrain control module 20 can control the pressure of the fuel in fuel rail 16 by controlling the speed of fuel pump 12, powertrain control module 20 can increase the fuel pressure to prevent impending vaporization. Powertrain control module 20 can best perform this countermeasure if powertrain control module 20 knows the temperature of the fuel in fuel rail 16.

Figure 2:
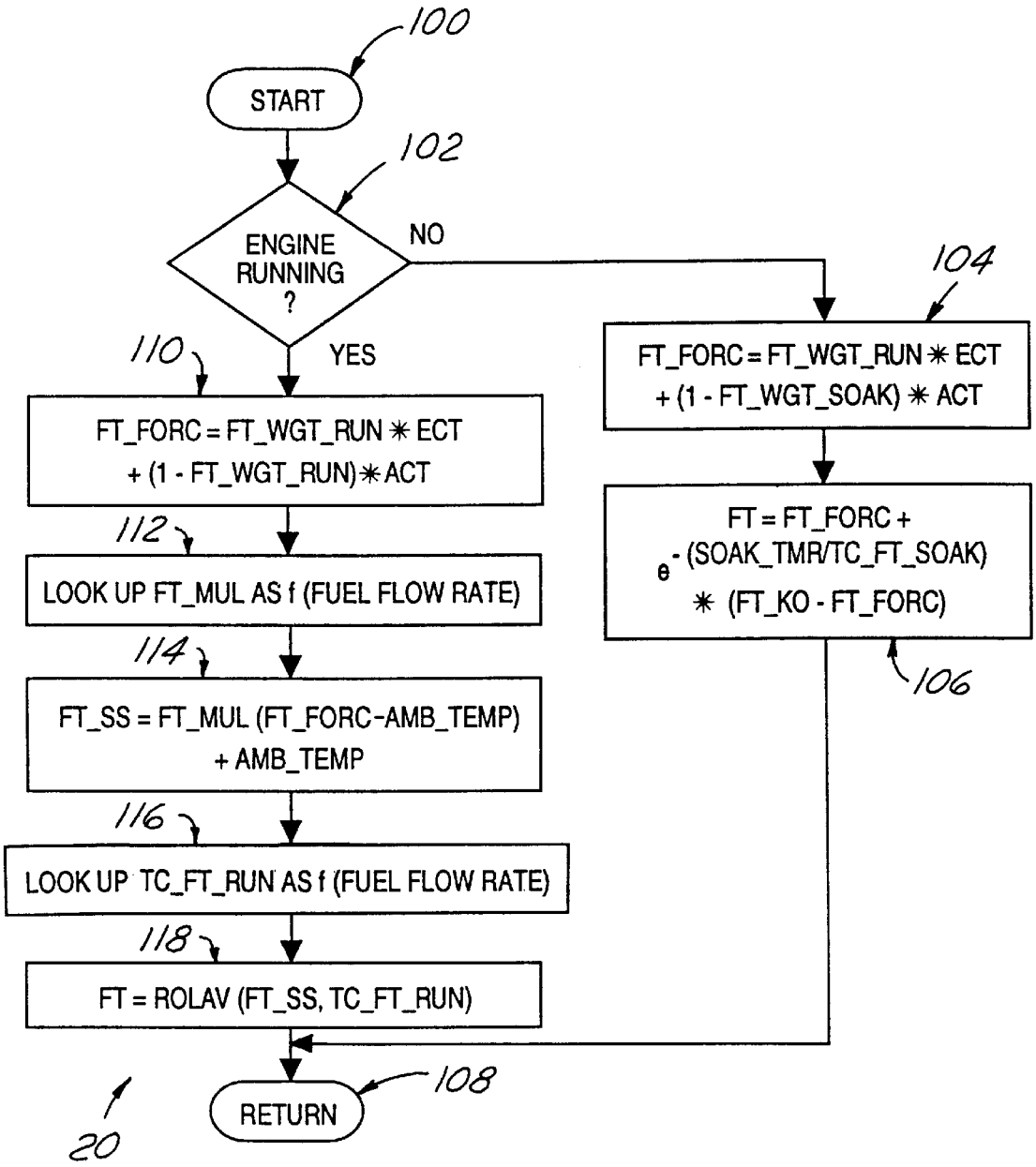
FIG. 2 illustrates an algorithm performed by powertrain control module 20 of FIG. 1 for estimating the temperature of the fuel in fuel rail 16.

An algorithm for performing estimation of the fuel temperature in fuel rail 16 is performed by powertrain control module 20 and is illustrated with further reference to FIG. 2. The algorithm begins at step 100. At step 102, it is determined whether the engine of the vehicle is running. This is a piece of information routinely known by powertrain controllers. If the engine is not running, the algorithm proceeds to step 104. (Steps 104 and 106 are the portion of the algorithm which estimates fuel temperature when the engine is not running.) At step 104, a "forcing function," FT_FORC, is calculated. FT_FORC is an average of engine coolant temperature and air charge temperature, because empirical observations have indicated that the temperature of the fuel in fuel rail 16 is bounded by engine coolant temperature and air charge temperature. FT_WGT_SOAK is a predetermined constant between zero and one and is determined during vehicle testing and development. It should be noted that FT_FORC is in general a weighted average of engine coolant temperature and air charge temperature, though in the special case of FT_WGT_SOAK being equal to 0.5, FT_FORC is an arithmetic mean of engine coolant temperature and air charge temperature.

At step 106, a fuel temperature estimate FT is calculated as:

$$FT=FT_FORC+e^{-(SOAK_TMR/TC_FT_SOAK)}*(FT_KO-FT_FORC), \quad (1)$$

where SOAK_TMR is the time since the engine was last running, TC_FT_SOAK is a time constant determined during vehicle testing and development, and FT_KO is the fuel temperature estimate from when the engine was last running. FT_KO is retrieved from non-volatile memory, preferably keep-alive RAM, where it was stored when the engine was turned off. FT_KO is calculated from the portion of the present algorithm which estimates fuel temperature in fuel rail 16 when the engine is running (steps 110–118), which will be described below.

According to Equation (1), when the engine first stops running (i.e., SOAK_TMR=0), the fuel temperature estimate FT is equal to the value of the fuel temperature estimate at key-off, FT_KO. This is to be expected. As SOAK_TMR increases, the effect of key-off fuel temperature exponentially decreases in favor of the forcing function FT_FORC. In the limit, if SOAK_TMR were to reach infinity, the fuel temperature estimate FT equals FT_FORC.

After step 106, the algorithm exits at step 108.

Figure 3:
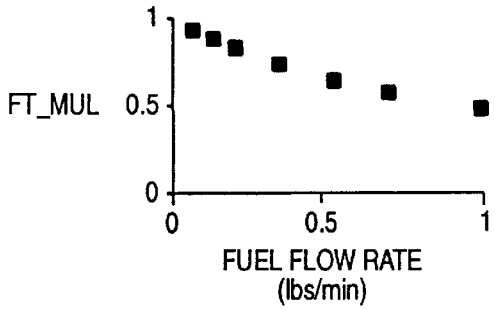
FIG. 3 illustrates the function defining the factor FT_MUL from FIG. 2 in one embodiment of the present invention.

If at step 102 it is determined that the engine is running, the algorithm progresses to step 110. (Steps 110 through 118 are the portion of the algorithm which estimates fuel temperature when the engine is running.) At step 110, a fuel temperature "forcing function" FT_FORC is calculated as a weighted average of engine coolant temperature and air charge temperature. The weighting factor, FT_WGT_RUN, is selected during vehicle testing and development. At step 112, a factor FT_MUL is looked up from a two-dimensional look-up table, with fuel flow rate as the independent variable. Fuel flow rate is known by powertrain control module 20, because one of the engine management functions performed by powertrain control module 20 is control of fuel injectors 18. The values in the FT_MUL look-up table are determined during vehicle testing and development. The values in the lookup table for one particular vehicle are graphically illustrated in FIG. 3. As can be seen in FIG. 3, FT_MUL decreases with increasing fuel flow rate.

At step 114, a steady-state fuel temperature estimate FT_SS is calculated as:

$$FT_SS=FT_MUL*(FT_FORC-AMB_TEMP)+AMB_TEMP, \quad (2)$$

where AMB_TEMP is actual or inferred ambient temperature in the vicinity of the vehicle. Ambient temperature is used as an approximation for the temperature of the fuel in fuel tank 10. One can see that the smaller the factor FT_MUL becomes, the closer FT_SS becomes to AMB_TEMP. This is because with greater fuel flow rate (which results in FT_MUL decreasing—see FIG. 3), the temperature of the fuel in fuel rail 16 more closely approaches the temperature of the fuel leaving fuel tank 10. That is, the greater the fuel flow rate, the less effect engine heating will have on the temperature of the fuel in fuel rail 16. Instead of actual or inferred ambient temperature, other approximations for the temperature of the fuel in fuel tank 10 (or actual temperature of the fuel, if that is available) can be used as well.

If actual ambient temperature is used as AMB_TEMP, that temperature can come directly from a sensor. Alternatively, an inferred ambient temperature can come from an ambient temperature estimation algorithm.

Figure 4:
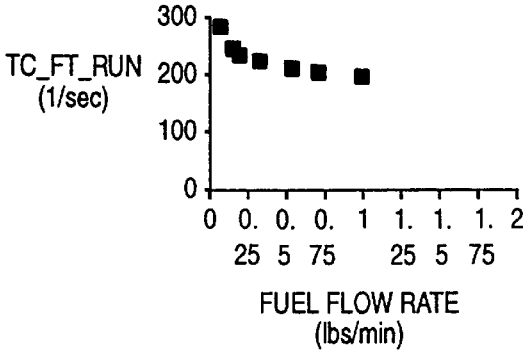
FIG. 4 illustrates the function defining the time constant TC_FT_RUN from FIG. 2 in one embodiment of the present invention.

At step 116, a time constant TC_FT_RUN is looked up from a two-dimensional look-up table as a function of fuel flow rate. The look-up table is populated during vehicle testing and development. The values of one such look-up table are illustrated graphically in FIG. 4. TC_FT_RUN is used at step 118 to model the thermal capacitance involved in changing the fuel temperature in the fuel rail. The function "ROLAV" at step 118 is an approximation of an exponential lag function. ROLAV uses a variable FK, which is defined as:

$$FK = \frac{1}{1+\frac{TC_FT_RUN}{t}}, \quad (3)$$

where t is elapsed time since a change in the steady-state fuel temperature estimate FT_SS. According to the "ROLAV" function applied at step 118, then, $$FT=(1-FK)*FT+FK*FT_SS, \quad (4)$$

where FT is the fuel temperature estimate in an engine running condition. Fuel flow rate, used as the independent variable for looking up TC_FT_RUN, is a first-order approximation of waste heat generated by the vehicle's engine. The higher the fuel flow rate, the more power (including waste heat) is generated by the engine. Thus, with a higher fuel flow rate (which indicates greater engine waste heat generation), TC_FT_RUN will be smaller, causing less of a lag time for fuel temperature estimate FT to follow the steady-state estimate FT_SS.

Instead of fuel flow rate being used as an indicator of engine waste heat generation, other indicators can be used as well, including air flow rate into the engine's intake manifold.

After step 118, the algorithm exits at step 108.

As was discussed above, the values of the various parameters FT_WGT_SOAK, TC_FT_SOAK, FT_WGT_RUN, TC_FT_RUN and FT_MUL are determined during vehicle testing and development in order to make the algorithm's calculated estimates of fuel temperature best agree with actual measured values. For one particular implementation of this fuel temperature estimation algorithm on a vehicle, the values of the parameters were selected as follows:

| Parameter | Value | Units |
|---|---|---|
| FT_WGT_SOAK | 0.5 | unitless |
| TC_FT_SOAK | 3500 | 1/sec |
| FT_WGT_RUN | 0.28 | unitless |
| FT_MUL | (as per Figure 3) | unitless |
| TC_FT_RUN | (as per Figure 4) | 1/sec |

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A method for controlling fuel delivery in a fuel delivery system of a motor vehicle engines said method comprising the steps of:

calculating a fuel temperature estimate in an engine running state in accordance with fuel flow rate, engine coolant temperature and intake air temperature to said engine; and modifying said fuel delivery in view of said fuel temperature estimate in an engine running state.

2. A method for controlling fuel delivery in a fuel delivery system of a motor vehicle engine, said method comprising the steps of:

calculating a fuel temperature estimate in an engine running state as a function of fuel flow rate, engine coolant temperature and intake air temperature to said engine; and modifying said fuel delivery in view of said fuel temperature estimate in an engine running state;

wherein said step of calculating a fuel temperature estimate in an engine running state further comprises the step of calculating an average of intake air temperature and engine coolant temperature.

3. A method as recited in claim 2, wherein said step of calculating a fuel temperature estimate in an engine running state further comprises the steps of:

determining a factor which is a function of fuel flow rate into said engine; and calculating a steady-state fuel temperature approximation as a function of actual or inferred ambient temperature in the vicinity of said vehicle, said factor and said average of intake air temperature and engine coolant temperature.

4. A method as recited in claim 3, wherein said steady-state fuel temperature approximation is calculated as:

$$FT_SS=FT_MUL*(FT_FORC-AMB_TEMP)+AMB_TEMP;$$

wherein FT_SS is said steady-state fuel temperature approximation, FT_FORC is said average of engine coolant temperature and intake air temperature, AMB_TEMP is said actual or inferred ambient temperature, FT_MUL is said factor; and FT_MUL decreases with increasing fuel flow rate.

5. A method as recited in claim 3, wherein said step of calculating a fuel temperature estimate in an engine running state further comprises the step of applying a lag function to said steady-state fuel temperature approximation to obtain a fuel temperature estimate.

6. A method as recited in claim 5, wherein said step of applying a lag function further comprises the step of using a time constant which is a function of fuel flow rate into said engine.

7. A method as recited in claim 5, wherein said step of applying a lag function further comprises the step of using a time constant which is a function of air flow rate into said engine.

8. A method as recited in claim 4, wherein said step of calculating a fuel temperature estimate in an engine running state further comprises the step of applying a lag function to said steady-state fuel temperature approximation FT_SS to obtain a fuel temperature estimate FT.

9. A method as recited in claim 8, wherein said step of applying a lag function further comprises the step of using a time constant which is a function of fuel flow rate into said engine.

10. A method as recited in claim 8, wherein said step of applying a lag function further comprises the step of using a time constant which is a function of air flow rate into said engine.

11. A method as recited in claim 2, wherein said step of calculating a fuel temperature estimate in an engine running state further comprise the steps of:

determining a factor which is a function of fuel flow rate into said engine; and calculating a steady-state fuel temperature approximation as a function of actual or inferred temperature of fuel in said fuel tank, said factor and said average of intake air temperature and engine coolant temperature.

12. A method recited in claim 11, wherein:

inferred temperature of fuel in said fuel tank is used in calculating said steady-state fuel temperature approximation; and actual or inferred ambient temperature in the vicinity of said vehicle is used as said inferred temperature of fuel in said fuel tank.

13. A method for controlling fuel delivery in a fuel delivery system of a motor vehicle engine, said method comprising the steps of:

calculating a fuel temperature estimate in an engine running state as a function of fuel-flow rate, engine coolant temperature and intake air temperature to said engine;

modifying said fuel delivery in view of said fuel temperature estimate in an engine running state; and calculating a fuel temperature estimate in an engine not running state as a function of a fuel temperature estimate when said engine was last in a running state, time said engine has been in said not running state, engine coolant temperature and intake air temperature.

14. A method as recited in claim 13, wherein said step of calculating a fuel temperature estimate in an engine not running state further comprises the steps of:

calculating an average of engine coolant temperature and intake air temperature;

calculating said fuel temperature estimate in an engine not running state as:

$$FT=FT_FORC+e^{-(SOAK_TMR/TC_FT_SOAK)}*(FT_KO-FT_FORC),$$

where FT is said fuel temperature estimate in an engine not running state, FT_FORC is said average of engine coolant temperature and intake air temperature, SOAK_TMR is said time that said engine has been in said not running state, TC_FT_SOAK is a time constant, and FT_KO is said fuel temperature estimate when said engine was last running.

15. A digital memory device adapted to direct a microcomputer to estimate temperature of fuel in a fuel delivery system of a motor vehicle engine, said digital memory device comprising:

means for directing a microcomputer to calculate an average of engine coolant temperature and engine intake air temperature;

means for directing a microcomputer to determine a factor as a function of fuel flow rate;

means for directing a microcomputer to determine a steady-state fuel temperature approximation in an engine running condition as:

$$FT_SS=FT_MUL*(FT_FORC-AMB_TEMP)+AMB_TEMP,$$

wherein FT_SS is said steady-state fuel temperature approximation, FT_MUL is said factor, FT_FORC is said weighted average of engine coolant temperature and engine intake air temperature, and AMB_TEMP is an inferred ambient temperature.

16. A digital memory device as recited in claim 15, further comprising:

means for directing a microcomputer to calculate a second average of engine coolant temperature and engine in take air temperature;

means for directing a microcomputer to calculate a fuel temperature estimate in an engine not running state as:

$$FT=FT_FORC+e^{-(SOAK_TMR/TC_FT_SOAK)}*(FT_KO-FT_FORC),$$

where FT is said fuel temperature estimate in an engine not running state, FT_FORC is said second average of engine coolant temperature and engine intake air temperature, SOAK_TMR is a time that said engine has been in said not running state, TC_FT_SOAK is a time constant, and FT_KO is a fuel temperature estimate when said engine was last running.

* * * * *